United States Patent [19]

Wahlberg

[11] 4,091,696

[45] May 30, 1978

[54] PLIERS

[75] Inventor: Ulf Wahlberg, Enkoping, Sweden

[73] Assignee: AB Bahco Verktyg, Enkoping, Sweden

[21] Appl. No.: 810,270

[22] Filed: Jun. 27, 1977

[30] Foreign Application Priority Data

Aug. 11, 1976 Sweden ..... 7608991

[51] Int. Cl.[2] ..... B25B 7/04

[52] U.S. Cl. ..... 81/396; 81/388

[58] Field of Search ..... 81/385–414, 81/346

[56] References Cited

U.S. PATENT DOCUMENTS

| | | | |
|---|---|---|---|
| 2,444,135 | 6/1948 | Kress | 81/396 |
| 3,824,882 | 7/1974 | Burthardt | 81/401 |

FOREIGN PATENT DOCUMENTS

| | | | |
|---|---|---|---|
| 215,696 | 9/1967 | Sweden | 81/396 |

*Primary Examiner*—James L. Jones, Jr.
*Attorney, Agent, or Firm*—Klarquist, Sparkman, Campbell, Leigh, Hall & Whinston

[57] ABSTRACT

A sliding joint pliers having a fulcrum pin projecting from one of its limbs and displaceably arranged in a slot in the second of its limbs, has an adjusting screw rotatably mounted on a carrying plate disposed between the limbs. The second limb has a rack along one edge for coaction with the adjusting screw so that the fulcrum pin can be set in a desired position in the slot. The carrying plate is non-rotatably positioned on the fulcrum pin and, together with the second limb and fulcrum pin, is pivotable in relation to the first limb.

1 Claim, 3 Drawing Figures

PLIERS

The invention relates to pliers with a sliding joint, having a fulcrum pin projecting from one of the limbs of the pliers and which is displaceably accommodated in a slot in the other limb of the pliers for adjusting the grip of the pliers. An adjusting screw is rotatably mounted in a carrying means, e.g. a plate, mounted around the fulcrum pin and suitably situated between the two limbs. There is further arranged a rack along an edge of said second limb, adjacent the slot, parallell to its longitudinal axis and adapted to coact with the adjusting screw. The fulcrum pin can hereby be set in a desired position in the slot by manual actuation of the adjusting screw.

Such pliers are known through the Swedish Patent specification No. 215,696. In applying the solution disclosed in the patent specification, it has been found that engagement between the adjusting screw and the rack is sometimes subjected to disturbances in the form of seizing or sticking which occasionally makes setting of the grip difficult.

The object of the invention is to provide improved pliers of the kind in question to circumvent the described drawbacks. The intended result is achieved by the pliers being given the characterizing features disclosed in the following patent claim.

An embodiment of the invention is described in detail in the following while referring to the attached drawing.

Figure 1:
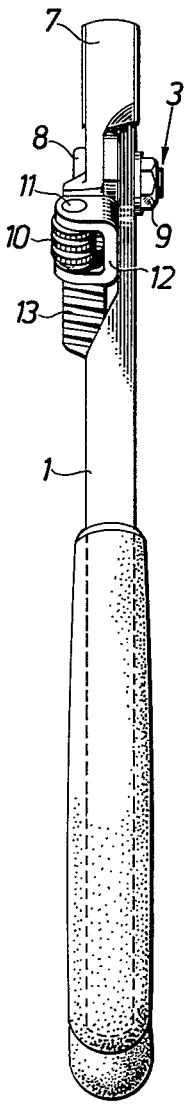
FIG. 1 is a view of a pair of sliding joint pliers, taken from the back.

The pliers have two limbs, 1,2 of which one limb 1 carries a fulcrum pin 3 and the second limb 2 is made with a rather long slot 4, extending along a shank portion 5 which is sloping in relation to the longitudinal axis of the pliers. Each limb is terminated with a jaw 6,7, the jaws being shaped to give the pliers a gripping function. The fulcrum pin 3 has a head 8, and its end remote from the head threaded and provided with a nut 9, for keeping together both limbs 1,2 in the pivoting portion of the pliers. The fulcrum pin 3 is thereby displaceably arranged in the slot 4 of the limb 2 for setting the grip of the pliers. The grip can naturally be varied in the usual way by action on the handles of the limbs to a suitable mutual angular attitude within the grip range determined by the position of the fulcrum pin in the slot 4.

An adjusting screw 10 is rotatably mounted on a pin 11 between a pair of ears on a plate 12, mounted around the fulcrum pin 3 and situated between both limbs 1 and 2, these limbs having substantially flat engagement surfaces against the plate 12, which is also substantially flat excepting the said ears.

A rack 13 is arranged along an edge of the sloping portions 5 of the limb 2, facing towards the adjusting screw 10 and parallell to the slot 4. The teeth of the rack 13 are adapted for engagement with the helical groove of the adjusting screw 10, whereby the fulcrum pin 3 can be adjusted to a desired position relative to the slot 4 by manual actuation of the adjusting screw.

Figure 3:
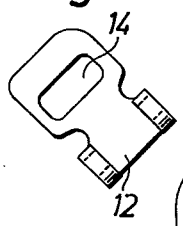
FIG. 3 is a view of the means carrying the adjusting screw.
Figure 2:
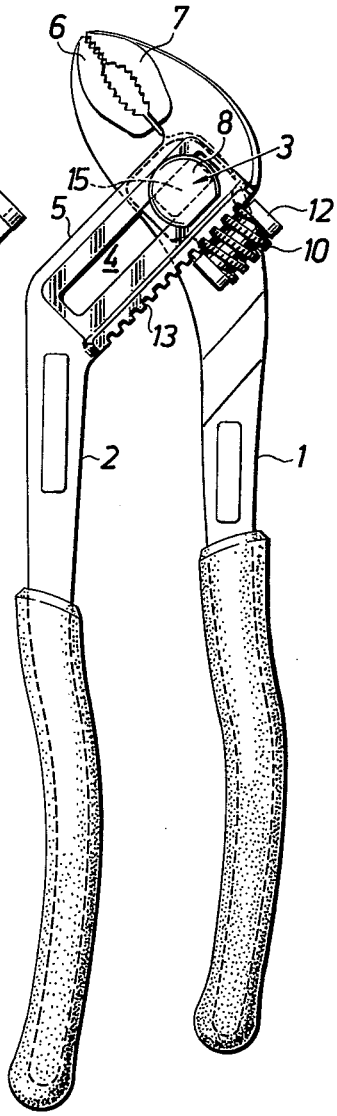
FIG. 2 is a view of the same pliers showing one side.

The plate 12 is non-rotatably arranged on the fulcrum pin 3. This being arranged by the plate having an elongate hole 14, as shown in FIG. 3, coacting for nonrotation with a complementarily shaped and dimensioned portion 15 of the fulcrum pin 3 under the head 8 (FIG. 2). This portion 15 has in cross section a length determined by the diameter of the head 8 and a width adapted for sliding movement in the slot 4, thus only insignificantly less than the width of the slot. The hole 14 of the plate is substantially rectangular and has its length and width adapted to the cross sectional dimension of the portion 15. The portion 15 extends through the limb 2 as well as the plate 12, but does not reach into the limb 1, which is made with a circular hole (not shown) for coaction with a portion of the fulcrum pin with a circular cross section, this portion having the previously mentioned thread for the nut 9 at its free end. Accordingly, the plate 12 together with the limb 2 and fulcrum pin 3 are pivotable as a unit in relation to the limb 1.

The plate carrying the adjusting screw does not need to be situated between the limbs of the pliers but can be situated outside the limb provided with the rack. The plate can be replaced with some other carrying means, e.g. a stirrup or U-shaped piece, with its shanks wrapped around the limb provided with the rack, the shanks thus extending between the limbs as well as outside the limb provided with the rack, and with at least one shank non-rotatably surrounding the fulcrum pin. The non-rotatable union between the carrying means and the fulcrum pin can also be arranged by welding or brazing, for example, instead of by the form-conditioned coupling engagement shown.

I claim:

1. A pair of sliding joint pliers with a fulcrum pin (3), projecting from one of the limbs (1) of the pliers, and displaceably arranged in a slot (4) in the second limb (2) of the pliers for adjusting the grip of the pliers, there being an adjusting screw (10) rotatably mounted in a carrying means (12), e.g. a plate, said carrying means being mounted round the fulcrum pin (3) and preferably placed between both limbs (1,2), a rack (13) being arranged along an edge of the said second limb (2), adjacent to the slot (4) and parallel to its longitudinal axis and adapted for coaction with the adjusting screw (10) so that the fulcrum pin (3) can be set in a desired position in the slot (4) by manual actuation of the adjusting screw (10), characterized in that the carrying means (12) is non-rotatably arranged on the fulcrum pin (3) and together with the second limb (2) and fulcrum pin (3) is pivotable in relation to the said first limb (1).

* * * * *